US006000736A

United States Patent [19]

Leon et al.

[11] Patent Number: 6,000,736

[45] Date of Patent: Dec. 14, 1999

[54] ROTATABLE SEAL

[75] Inventors: Jeremy Phelps Leon, Morris Plains; Peter Farbaniec, Colonia; Robert J. Finamore, Little Falls; Richard Dreisbach, North Arlington; Louis J. Mattos, West Carteret; George Albert Lundberg, Jr., Pompton Plains; Richard Gnoinski, North Arlington, all of N.J.

[73] Assignee: E.J. Brooks Company, Livingston, N.J.

[21] Appl. No.: 09/070,055

[22] Filed: Apr. 30, 1998

[51] Int. Cl.[6] ..... B65D 27/30

[52] U.S. Cl. ..... 292/326; 292/307 R; 292/315; 24/909

[58] Field of Search ..... 292/307 R, 307 B, 292/315, 317, 320, 326, 327, 328, 330; 220/214; 24/909, 71.1, 68 R, 68 SK, 68 CD; 242/388.1

[56] References Cited

U.S. PATENT DOCUMENTS 4,978,026 12/1990 Gnoinski ..... 292/307 R
5,180,200 1/1993 Georgopoulos et al. .
5,402,958 4/1995 Mahaney ..... 292/307 R
5,419,599 5/1995 Georgopoulos .

*Primary Examiner*—Teri Pham
*Attorney, Agent, or Firm*—John J. Gilfillan, III; William Squire

[57] ABSTRACT

A thermoplastic housing has a chamber open at one end and a thermoplastic rotor is locked axially in the chamber by snap fit ridges and grooves. Two pairs of bores on opposite sides; of the chamber are aligned, with one pair connected by a transverse slot. The rotor has two bores aligned with the housing bores and includes flexible pawl teeth which engage ratchet teeth in the chamber. The teeth rotationally lock the rotor relative to the housing in one direction while a seal filament inserted in the bores is wrapped about the rotor as the rotor is rotated in the other direction. The slot permits the filament to be fixed to the rotor when the rotor is rotated 180° causing the filament to traverse the slot and permit the remaining adjacent bores in the same plane as the fixed filament to be aligned and free to receive the filament free end. The rotor is rotated relative to the housing manually by finger gripped flanges attached to the rotor and to the housing with the filament inserted to wrap and lock the filament to the rotor. The rotor and housing define a channel for receiving multiple turns of filament to enhance the locking action.

21 Claims, 5 Drawing Sheets

FIG. 3
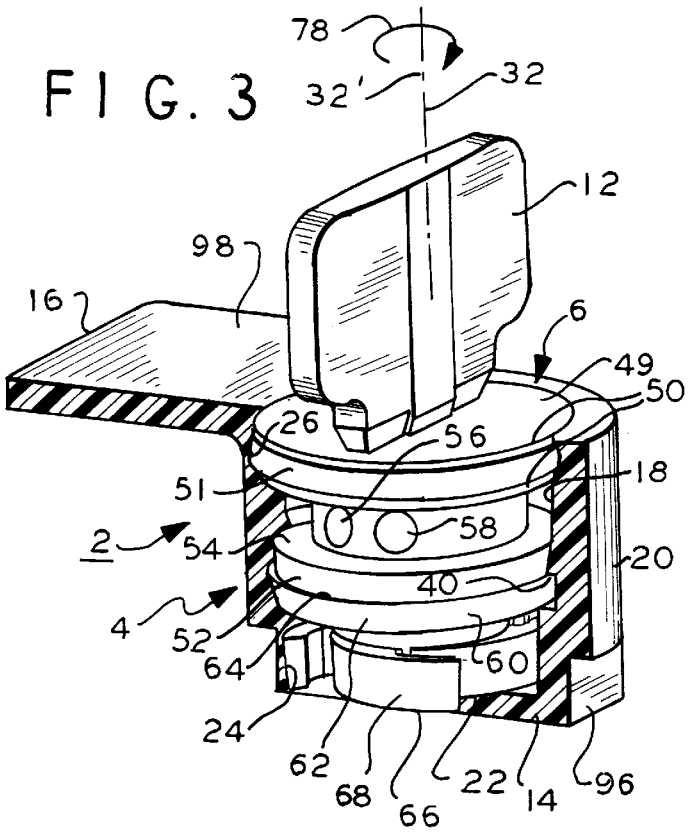
FIG. 4
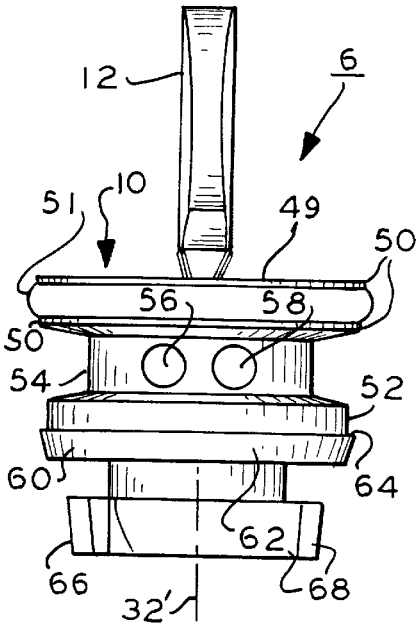
FIG. 5
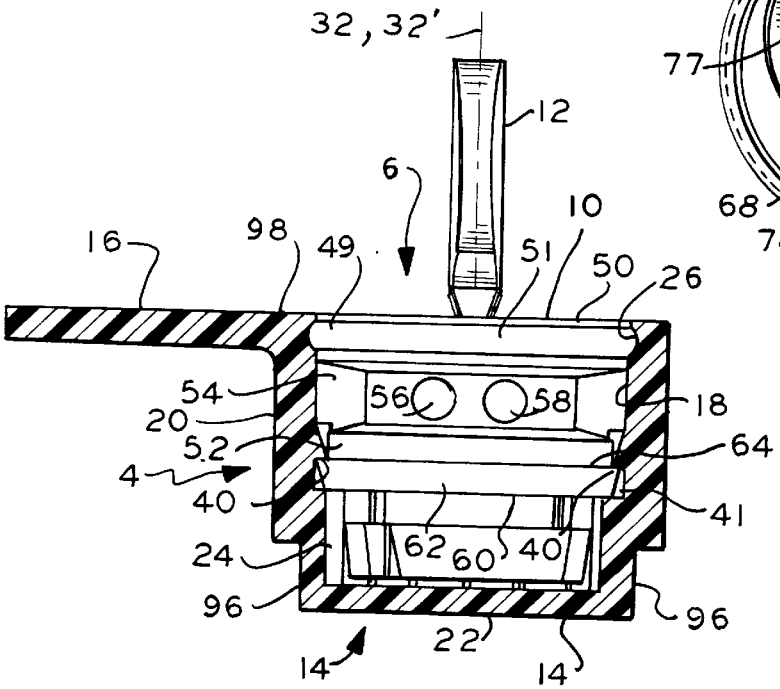
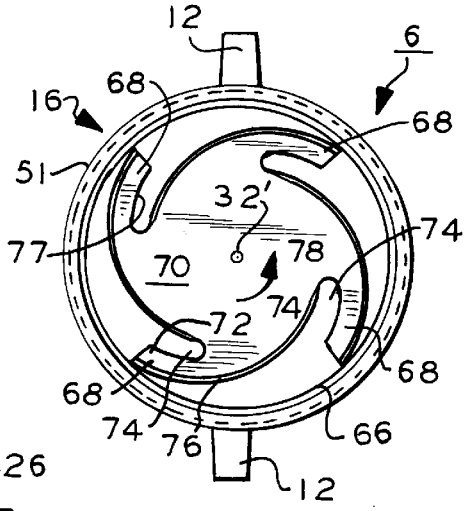
FIG. 6

ROTATABLE SEAL

This invention relates to a rotatable seal for securing containers and for preventing removal of sealing wire from a hasp, staple or similar member of a lock or latch which secures a container. The seal is destroyed when removed.

CROSS-REFERENCE TO RELATED PATENTS

Of interest are commonly owned U.S. Pat. Nos. 4,978,026, 5,180,200 and 5,419,599 which relate to rotatable seals.

BACKGROUND OF THE INVENTION

Various devices for sealing the hasps or staples of locks or latches which secure cargo containers comprise an elongated, flexible sealing wire and a metal or thermoplastic seal. The wire is passed through the hasp or staple and then its ends are retained by the seal which is crimped or deformed to prevent removal of the wire ends. Since the presence of the wire prevents operation of the hasp or staple, unauthorized entry into the container entails destroying the seal or the wire creating visual evidence of the unauthorized entry.

Examples of prior art seals may be found in U.S. Pat. Nos. 421,951, 1,826,033 and 1,911,060.

U.S. Pat. No. 421,951 discloses a rotatable seal lock wherein a strip seal is inserted within a rotatable member. Thereafter the member is rotated causing a dog to be received within an opening in the strip and pulled within the rotatable member to a retained position. The rotatable member is held against unlocking rotation by the use of a spring-loaded pawl.

U.S. Pat. No. 1,826,033 discloses a block with a sealing chamber with transverse holes. A roller is in the chamber and has a cross-partition for temporary engagement with a winding means inserted through the chamber. The winding means has holes to receive a sealing band.

U.S. Pat. No. 1,911,060 discloses a sealing device having a body with apertures through which-a flexible sealing means can extend. The center portion of the body is provided with a threaded bore which is intersected by the apertures. Disposed within the threaded bore is a uni-rotational screw which may be tightened down against the flexible securing means to retain it in a sealed position.

The aforementioned, commonly owned U.S. Pat. Nos. 4,978,026, 5,180,200 and 5,419,599 provide a seal for securing a container and provide evidence of tampering as well as being economical to manufacture. In the U.S. Pat. No. 5,180,200 seal, a rotatable rotor is insertable in a chamber in a thermoplastic housing. The housing wall contains bores aligned across the chamber. The housing wall further has two annular grooves adjacent the chamber entrance. The rotor has a bore and two annular ridges, curved in transverse section complementary to the grooves, near its top. The rotor is partially inserted in the housing by snapping the lower ridge into the upper groove of the chamber and locating the tabs on the housing in relieved areas to align the bores so that a seal wire may be inserted through the aligned bores. With a seal wire inserted, the rotor and housing are relatively rotated to wrap the wire about the rotor. The rotor is then fully axially inserted into the housing so that each ridge snaps into a groove. This and engagement of teeth on the bottom of the rotor which mate with teeth at the chamber base prevent removal of the rotor from the housing, relative rotor-housing rotation, and removal of the wire from the seal.

However, the rotor is only partially inserted when it receives a sealing wire after which the rotor is rotated and then fully inserted. The rotation of the rotor to wrap the wire thereabout and fully insert the rotor into the chamber requires a special tool.

U.S. Pat. No. 5,419,599 ('599) discloses a seal similar to that in U.S. Pat. No. 5,180,200 except a ratchet and pawl mechanism permit relative rotation of the rotor to the housing in only one direction when the rotor is fully inserted. Also, a screw driver can rotate the seal without a special tool.

U.S. Pat. No. 5,402,958 discloses a seal with a ratchet and pawl mechanism similar to that in the '599 patent. Like that seal, this patent seal requires a screw driver or similar tool to rotate the seal rotor to wrap the wire about the rotor and lock the seal. Also, like the other patents discussed above, mating curved in transverse section ridges and grooves axially lock the rotor in the housing chamber. These grooves and ridges, however, have arcuate surfaces which may be defeatable by tampering.

The present inventors recognize a need for a seal similar to the one disclosed in the aforementioned U.S. Pat. Nos. 5,419,599, 5,402,958 and so on, but wherein the wire filament can be wrapped about the rotor without tools. In addition, the present inventors recognize a need to secure one end of the filament to the seal at the factory. The '599 and related patents can not do that. If the filament has only one end wrapped about the rotor, the wrapped filament will block the other openings in the seal that are coplanar therewith and preclude insertion of the filament other end by the end user. The '958 patent does not have this problem as its openings are provided in different planes. But this device requires a tool to operate.

A seal according to the present invention for use with a flexible filament for non-removable attachment of the filament to an article comprises a housing defining a chamber having an axis, an opening through the housing in communication with the chamber and lying in a plane transverse the axis, the opening being sufficiently large for receiving therethrough first and second portions of the filament in side-by-side communicating relation in the plane.

A rotor is in the chamber and has at least one bore and is rotatable about the axis, the at least one bore in the rotor being aligned with the opening in the plane for receiving the filament.

One way motion means are in the chamber for permitting the rotor to be relatively rotated with respect to the housing in only one direction about the axis for wrapping the filament received in the at least one bore and in the opening about the rotor to secure the filament to the rotor and housing.

The opening in one aspect comprises a slot extending transverse the axis.

The slot may comprise first and second bores in spaced relation and a slot portion intersecting each of the first and second bores, the at least one bore comprising adjacent spaced third and fourth bores lying in the plane, the third bore being aligned with the first bore and the fourth bore being aligned with the second bore.

The housing in a further aspect has fifth and sixth bores, the first and third bores being aligned with the fifth bore and the second and fourth bores being aligned with the sixth bore in the plane.

In a further aspect, the housing has a pair of lips in the chamber on opposing housing walls, each lip having coplanar first surfaces normal to the axis, the rotor having a shoulder having a second surface normal to the axis and complementary to and for engaging each of the lips for axially locking the rotor to the housing.

The rotor and housing in a further aspect define an annular channel therebetween in the plane, the channel for receiving multiple wrappings of the filament about the rotor.

The channel preferably may have a cross sectional area of at least quadruple the cross sectional area of the filament.

The one way motion means may comprise complementary ratchet and pawl means secured to the rotor and to the housing in the chamber.

The housing and the rotor preferably have further complementary surface features for axially retaining the rotor to the housing.

In a further aspect, means radially extend from the housing to provide a finger grip, and a finger gripping flange extends from the rotor for manually rotating the rotor in the chamber without tools.

The lip is linear in a further aspect and has a surface that extends through opposing through-bores in the housing.

In a still further aspect including the filament having opposite first and second ends, the filament comprises a cylindrical flexible elongated member, the first end terminating in one of the third and fourth bores and wrapped about the rotor one half a revolution in the chamber, the filament passing through the opening with its second end external the housing.

IN THE DRAWING

FIG. 3 is an isometric view of the rotatable seal of FIG. 1 partially in section without the filament in place;

FIG. 4 is a side elevation view of the male rotor of the seal of FIG. 3;

FIG. 5 is a side elevation view of the seal of FIG. 3;

FIG. 6 is a bottom plan view of the rotor of the rotatable seal of FIG. 4;

DETAILED DESCRIPTION OF THE PREFERRED EMBODIMENTS

Figure 1:
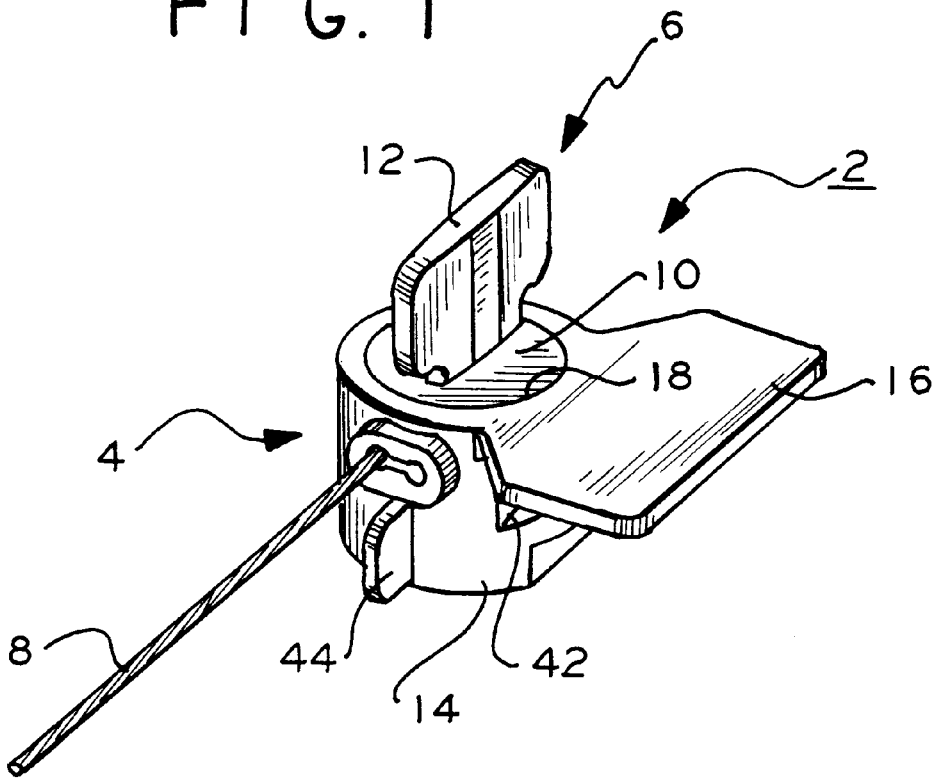
FIG. 1 is an isometric view of a rotatable seal with a filament attached, as available prior to locking of the seal according to an embodiment of the present invention.
Figure 2:
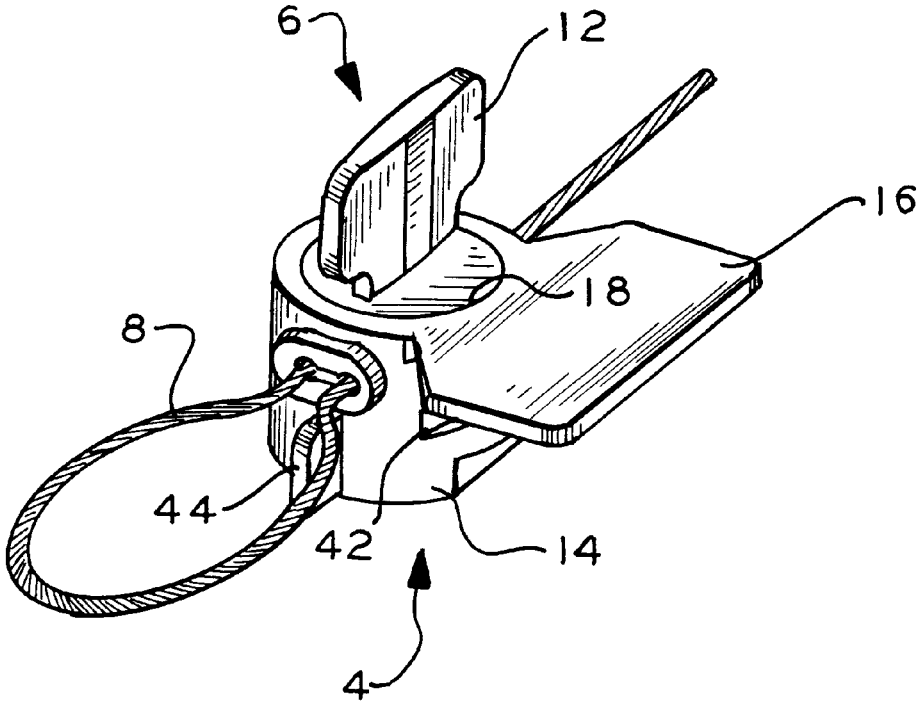
FIG. 2 is an isometric view of the rotatable seal of FIG. 1 after locking of the filament in a locked state of the seal.

Rotatable seal 2, FIGS. 1–2, includes a female housing 4, a male rotor 6, and a flexible locking filament 8, preferably stranded wire or a thermoplastic monofilament size-on-size. The term filament is intended to include monofilaments of thermoplastic material, solid wire or solid strands of non-metallic material and stranded cables. The drawing figures illustrate the filament 8 as a stranded wire cable by way of example.

The term "size-on-size" refers to the diameter of the filament as having a dimension that is variable in value from a maximum dimension (zero upward tolerance) to a minimum dimension or negative tolerance range. For example, a 0.010 inch (0.254 mm) size-on-size monofilament has a maximum diameter of 0.010+0.0 inches and a minimum value that may be 0.010−xxx inches. The stranded wire filament 8 is preferably about 0.030 inches (0.76 mm) in diameter in this embodiment. The monofilament is preferably 0.010 inches in diameter. The housing 4 and rotor 6 are both preferably molded frangible thermoplastic, but may be other materials.

The rotor 6 includes a rotor body 10 and a manually operated finger gripped flange 12. The flange 12 is used to rotate the rotor relative to the housing 4. The housing 4 preferably has a generally circular cylindrical hollow body 14 and a radially outwardly extending planar flag 16. The housing exterior may be any desired shape. The housing body 14 has a generally cylindrical chamber 18 in which the rotor body 10 is rotatably seated.

Figure 7:
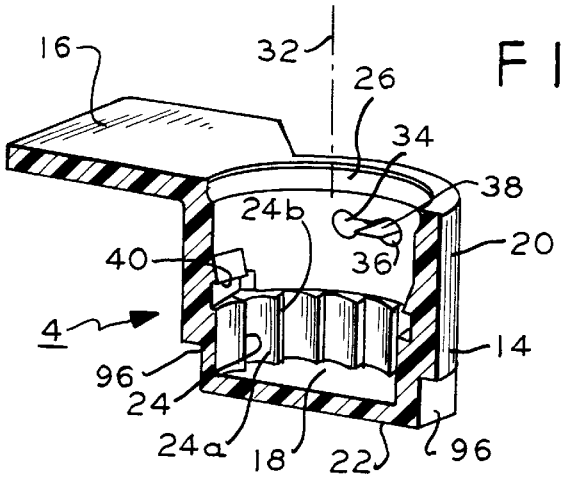
FIG. 7 is a sectional isometric view of the female housing of the seal of FIG. 3.
Figure 9:
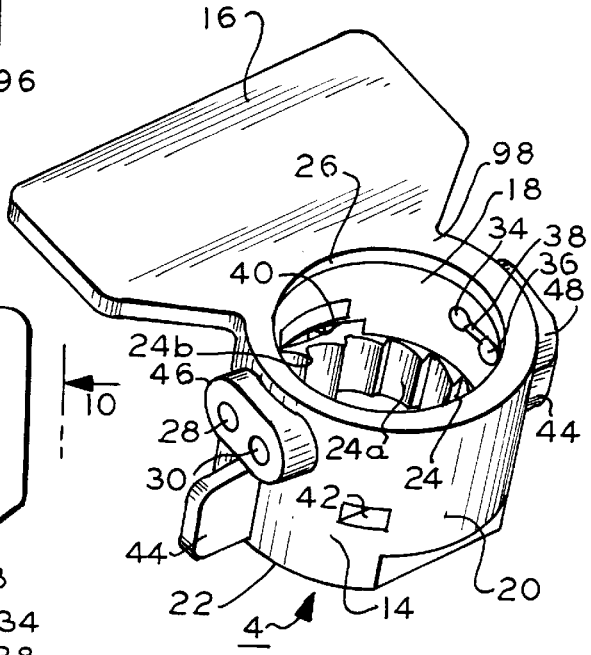
FIG. 9 is an isometric view of the female housing of the seal of FIG. 8.

In FIGS. 3, 5 and 8–11, the housing 4 has a generally circular cylindrical, side wall 20 enclosing circular in cross-section chamber 18 which is closed at one end by a base 22. Formed in the wall 20 and in the base 22 at their junction projecting into chamber 18 are a plurality of circumferential spaced ratchet teeth 24. The teeth 24, FIGS. 7 and 8, each have a gradual trailing rake **24*a* and a steep leading rake 24*b*. The depth of the teeth 24 (the radial depth of rake 24*b* from central axis 32) is not critical, and the function of the teeth will be described in more detail below. In this embodiment, the teeth 24 each subtend an angle of about 22.50° and have radially interior surfaces that are preferably circular segments parallel to axis 32 and in this implementation have a radius of 0.213 inches (5.4 mm) from axis 32. The rakes 24*b* each lie on a radius from the center of the chamber 18 at axis 32 in the plan view of FIG. 8**.

An annular groove 26 of a circular segment in cross section is formed in the interior of the wall 20 at the open end of the chamber 18. Formed through the wall 20 below the groove 26 and above the teeth 24 is a pair of bores 28, 30. The bores 28 and 30 are of like diameter, preferably 0.062 inches (1.6 mm) for use with a stranded wire filament of about 0.030 inch diameter. The bores 28 and 30 lie in a plane 29 parallel to the planar base 22 normal to the chamber 18 central axis 32.

Formed through the wall 20 below the groove 26 and above the teeth 24 is a second pair of bores 34, 36 lying on plane 29. The bores 34 and 36 are of like diameter as the bores 28, 30. The bores 34 and 36 are interconnected by a slot 38 aligned across the chamber 18, the slot having a width parallel to the axis 32 of about 0.035 inches (0.9 mm). The slot 38 width closely receives the filament but is smaller than the bore diameters to minimize entry of tampering tools into the chamber 18.

The bores 28 and 34 are aligned on axis A. The bores 30 and 36 are aligned on axis B. The bores 34 and 36 and slot 38 together form a slotted through-bore in the wall 20. The respective axes A and B extend across the chamber 18. Further, the bore pairs 28, 34 and 30, 36 are preferably mutually parallel and parallel to the base 22 and are coplanar. Those skilled in the art will appreciate that other arrangements are possible. For example, the slot 38 and bores 28, 34 may comprise a single width slot or a relatively enlarged bore for the purpose to be described below, notwithstanding a minimum size opening is desired to minimize entry of tampering tools into the chamber 18.

Figure 11:
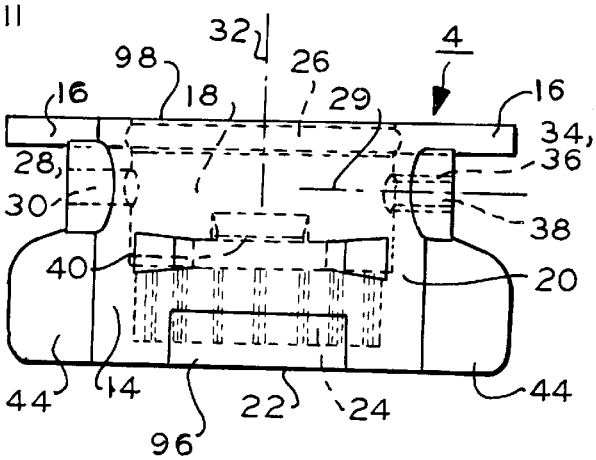
FIG. 11 is a side elevation view of the female housing of FIG. 8 taken along lines 11—11.
Figure 10:
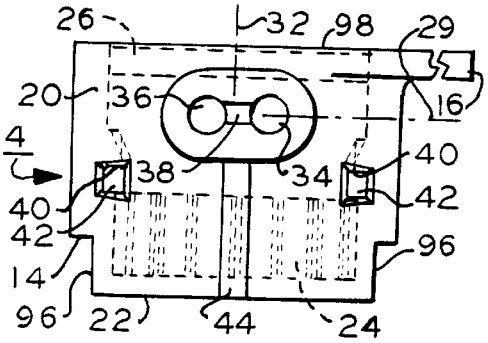
FIG. 10 is a side elevation view of the female housing of FIG. 8 taken along lines 10—10.

Formed in the interior of the housing 4 in chamber 18 above the teeth 24 are two opposing lips 40 extending radially inwardly. The lips 40 are formed by a linear channel 41 in the interior side of the wall 20. The lips 40 are mirror images and comprise a planar surface parallel to the plane 29 (FIGS. 10 and 11). The lips 40 are linear and have a common lower planar surface coplanar with a surface of the openings 42 in the side wall 20 which openings are extensions of the channels 41. The openings 42 are provided merely to permit the lips 40 and channels 41 to be formed by a corresponding die during the molding process. The openings 42 have no seal function.

The housing 4 includes diametrically opposite radially outwardly extending flanges 44 on the external side of wall 20. The flanges 44 are employed to provide leverage for rotating the rotor 6 relative to the housing 4. Cowls 46 and 48 are integrally formed with the wall 20 on opposite sides thereof. The cowls 46 and 48 contain continuations of the bores 28, 30 and 34, 36 and slot 38, respectively. The cowls serve to lengthen these bores to limit access to the chamber 18 by tampering tools. The flanges 44 and cowls 46 and 48 may be omitted.

The rotor 6 is shown in more detail in FIGS. 3–6. The rotor 6 is generally circular cylindrical and has various portions of varying transverse diametrical dimensions. The rotor 6 includes a head 49 with circular cylindrical spaced portions 50. Flange 12, which is sheet-like, extends upwardly from the head 49 and is molded one piece therewith. An annular outer ridge 51 formed one piece with the rotor is between portions 50, is complementary to and engages the groove 26 in the housing 4 (FIG. 3) in snap fit relation. In the alternative, a groove (not shown) may be formed in the head and a complementary ridge formed in the housing 4 wall 20.

Circular cylindrical portion 52 is spaced from the head 49 by annular channel 54. The portions 50 each have an external diameter substantially equal to that of the chamber 18 internal diameter. The portion 52 has a diameter smaller than the diameter of portions 50 and the chamber 18 for abutting the lips 40 interior edges, FIG. 5.

The head 49 and portion 52 are spaced from each other a distance to provide a channel 54 width parallel to axis 32. This width is sufficient to permit at least two abutting filament 8 portions to be wrapped about the rotor in the channel 54 in a direction parallel to the axis 32'. The channel also has a radial depth in a direction normal to the axis 32' sufficient for at least two layers of filament 8 portions to be wrapped thereabout. For example, with a filament diameter of about 0.030 inches (0.8 mm), the channel 54 preferably has a width of about 0.100 inches (2.5 mm) and a radial depth of about 0.120 inches (3 mm). These dimensions are sufficient to accommodate three overlying layers of filament 8 portions radially and axially providing a cross section volume that is at least quadruple that of the filament.

A pair of through-bores 56 and 58, FIG. 4, are formed in the body 10 in the channel 54. The bores 56 and 58 are preferably the same diameter as the bores 28, 30, 34 and 36 in the housing 4, e.g., 0.062 inches (1.6 mm). The bores 56 and 58 align with the housing bores on respective axes A and B, FIG. 8, in one angular orientation of the rotor 6 about axis 32 of the housing 4, the axes 32 and 32' being coaxial in the assembled state of FIG. 3.

Next below the portion 52 is an annular ridge 60 having an inclined radial outer cam surface 62 with the largest diameter nearest the head 49. The ridge 60 has an upper surface shoulder 64. Shoulder 64 is planar and is normal to the axis 32' parallel to the lip surfaces 40. The shoulder 64 engages the surfaces 40 in the rotor inserted state of FIGS. 3 and 5, permanently locking the rotor in the chamber 18. The ridge 60 snaps and flexes with the lips 40 to the locked engaged state with the lips 40. This provides a more secure anti-tampering locking action than the curved ridge 51 and complementary groove 26.

At the bottom of the rotor 6 is a disk 66 from which are radially projecting spiral-like flexible identical teeth 68. Each tooth 68 spirals radially outwardly from the disk 66 in a plane. The teeth 68 have a curved radial external surface, preferably a circular segment and taper cantilevered from the central portion 70 of the disk 66 to a relatively narrower tooth crest 72. Each tooth 68 is spaced from the next adjacent tooth 68 by a spiral-like space 74.

Because of the narrowing of the teeth 68 toward their crests 72 and their cantilevered shape, the teeth 68 are radially flexible in the plane in which they lie. The teeth 68 radially resiliently flex when rotated in engagement with the ratchet teeth 24 of the housing. The teeth 68 mate with the ratchet teeth 24 and serve as pawls relative to the ratchet teeth 24.

Preferably the radial outer external surface 76 of the teeth 68 are segments of a circle as is the radial internal surface 77 thereof. The crests 72 each lie on a radius emanating from the rotor axis of rotation 32', FIG. 6. Each tooth 68 respective radial inner surface 77 and outer surface 76, are defined by corresponding radii emanating from a point spaced radially from the rotor axis 32'. All of the teeth 68 are generated by the same two radial distances, but whose emanating points are rotated equally about the rotor axis 32', e.g., 90° in this embodiment.

All of the teeth 68 are generated by identical inner and outer surface radii that emanate from points that are spaced from axis 32' in the same relationship, but at different locations about axis 32'. The relative angular spacing about axis 32' for each of the inner and outer surface radii is the ,same for each tooth 68. Thus for four teeth 68, the radii thereof and corresponding emanating points are rotated four equal distances about axis 32'. The radii in this implementation may be 0.135 inches (3.4 mm) for the inner tooth surface 77 and 0.170 inches (4.3 mm) for the outer tooth surface 76. The surface 77 may subtend an angle of about 35°.

When the spiral-like teeth 68 are aligned coplanar with ratchet teeth 24, FIGS. 3 and 5, the rotor 6 can only rotate in one angular direction about the axes 32, 32' due to the engagement of the pawl teeth 68 with the ratchet teeth 24.

As the rotor 6 rotates in direction 78, the teeth 68 flex radially inwardly in a plane permitting relative rotation of the rotor. Normally, the quiescent state of teeth 68 is such that teeth 68 lock in engagement with teeth 24, preventing reverse rotation as occurs in a typical ratchet and pawl action.

As the rotor 6 rotates, the pawl teeth 68 ride up the ramp formed by teeth 24 rake 24*a* and flex radially inwardly. The teeth 68 then snap return to the state shown when in this relative position.

The rotor 6 is fully inserted axially into the chamber 18 to the axial position shown in FIGS. 3 and 5. The ridge 51 is snapped into the groove 26 simultaneously with the shoulder 64 being snapped into the channel 41. The diametric differences between the ridges 51, 60 and the mating respective groove is such that the rotor 6 is easily rotated within the chamber 18 relative to the housing 4 in direction 78, but is also locked axially in chamber 18 along axis 32.

The disk 66 teeth 68 are complementary to the teeth 24 in the chamber 18, the teeth having sufficient clearance so that upon insertion they are aligned coplanar and engaged. This engagement may be provided by simultaneous rotation of the rotor 6 relative to the housing 4 during axial insertion of the rotor into chamber 18. The teeth 68 taper radially inwardly in a direction toward axis 32' and toward the rotor bottom wall, FIG. 4, to assist in insertion of the rotor 6 into engagement. with the teeth 24, FIG. 8.

When the rotor 6 is fully inserted into the housing 4 and the ridge 60 is seated in the groove 40 (with the ridge 51 seated in the groove 26), the teeth 24 and 68 mesh and prevent relative rotation of the housing 4 and the rotor 6 in a direction opposite direction 78.

Figure 8:
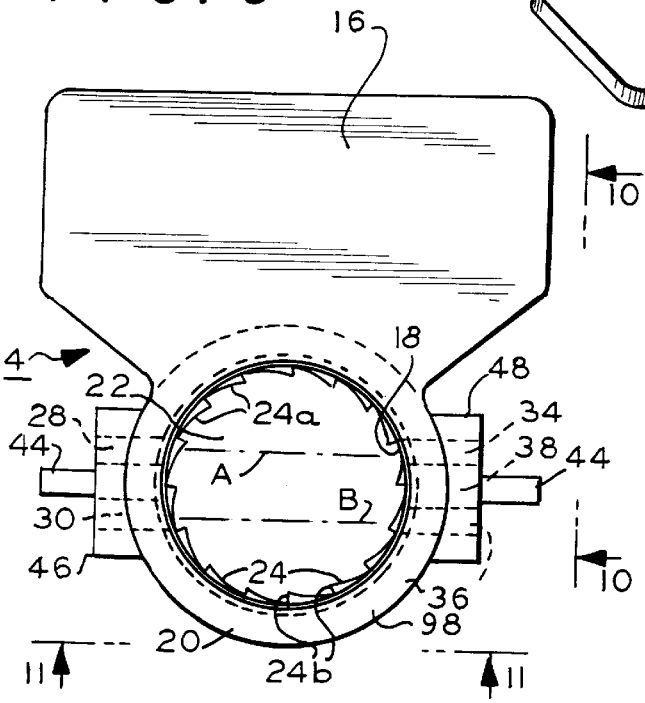
FIG. 8 is a top plan view of the female housing of the seal of FIGS. 1 and 2.
Figure 12:
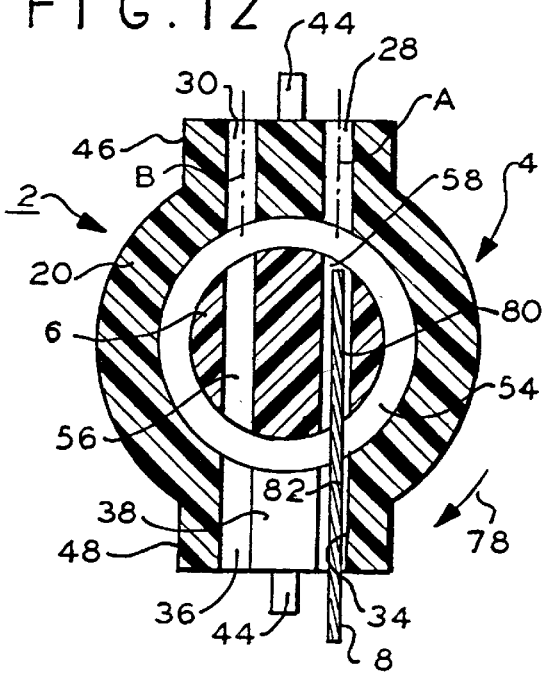
FIG. 12 is a top plan sectional view of the seal of the present invention showing the initial stage of attachment of the filament to the rotor and housing assembly.

When the rotor 6 is inserted into the chamber 18, FIG. 8, the axes of the bores 56 and 58 of the rotor (FIG. 5) are aligned with the respective axes B and A of the corresponding respective bores 30, 36 and 28, 34 of the housing 4. This is shown in FIG. 12. The rotor 6 may be rotated to align the bores to the position shown. Alignment devices (not shown) may be provided as shown in the aforementioned commonly owned patents to assist in aligning the rotor bores to the housing 4 bores.

FIGS. 12–16 show an embodiment of the rotatable seal 2 of the present invention in various stages of securing the filament 8 to the seal. In FIG. 12, an end portion 80 of the filament 8 is inserted into the rotor bore 58 through the housing bore 34. This is preferably performed in the factory. The rotor 6 is rotated 180° to the position of FIG. 13. This aligns the bore 58 with bores 30, 36. During this rotation, the filament portion 82 wraps about the rotor 6 in channel 54.

Figure 13:
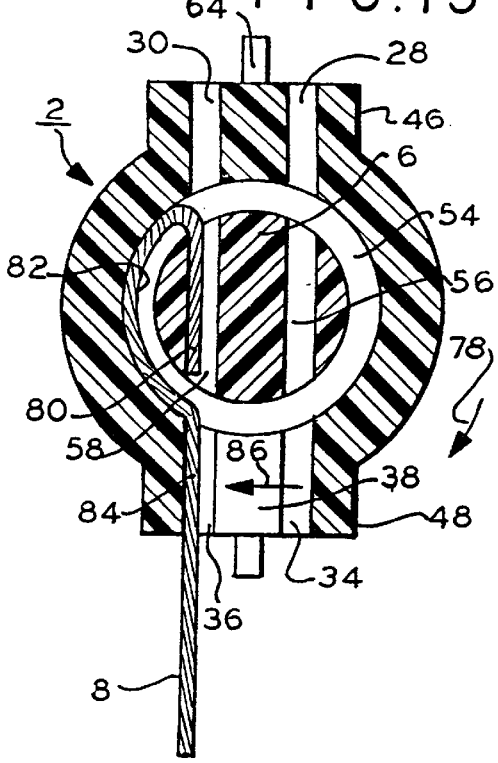
FIG. 13 is a top plan sectional view of the seal of FIG. 1 showing the final stage of attachment of the filament to the rotor and housing assembly.

In wrapping the filament 8 about the rotor 6 portion 84 is displaced through slot 38, direction 86, from bore 34 into bore 36, FIG. 13. This stakes the end portion 80 to the seal 2. The seal in this state is then shipped from the factory to a customer for end use. As shown in FIG. 13, the channel 54 is sufficiently enlarged relative to the filament, so as to permit further filament portions to wrap about the rotor in the channel 54 in the radial direction and in the axial direction.

Figure 14:
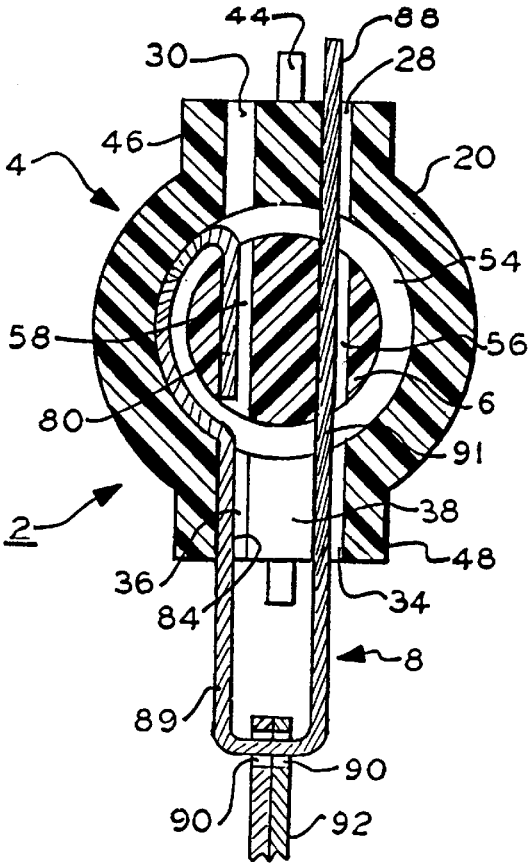
FIG. 14 is a top plan sectional view of the seal of the present invention showing a preliminary stage of attachment of the filament to the rotor and housing assembly in the locking mode for locking an article thereto.

In FIG. 14, the end portion 88 of filament 8 is passed through openings 90 of a hasp 92 to be secured by the seal 2. The end portion 88 is then inserted in the now clear bore 34, through the rotor 6 bore 56 and through the housing bore 28 and externally the housing 4. This permits the loop 89 to be adjusted in size. The other end portion 80 remains secured to the rotor 6 as shown. The rotor is rotated relative to the housing 4 to the position of FIG. 15 with filament portion 91 in the bore 56.

The rotor is rotated by grasping its flange 12 with the fingers of one hand and grasping the housing 4 via its flanges 44 with the fingers of the other hand. The filament portion 91 remains locked to the rotor in bore 56 during rotation.

Figure 15:
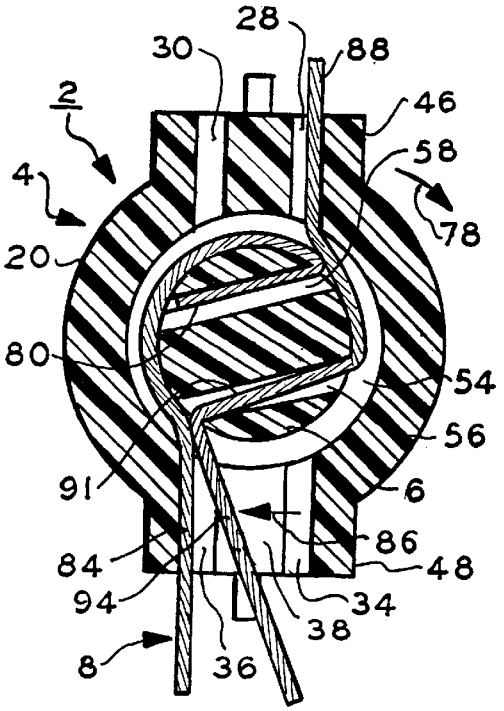
FIG. 15 is a top plan sectional view of the seal of the present invention showing an intermediate locking stage of attachment of the filament to the rotor and housing assembly.

In FIG. 15, the rotor 6 is further rotated as shown in an intermediate stage relative to the housing 4. As the rotor 6 is further rotated, the filament portion 94 is forced toward the portion 84 through the slot 38 in the housing 4 as it is pulled into the channel 54 about the rotor. The slot 38 has a dimension in the axial direction sufficient to just permit the filament portion to pass therethrough. Of course as the portion 94 traverses through the slot 38 it is also being wrapped about the rotating rotor 6. The filament end portion, 88 is also being wrapped about the rotor and is pulled into the channel 54.

Figure 16:
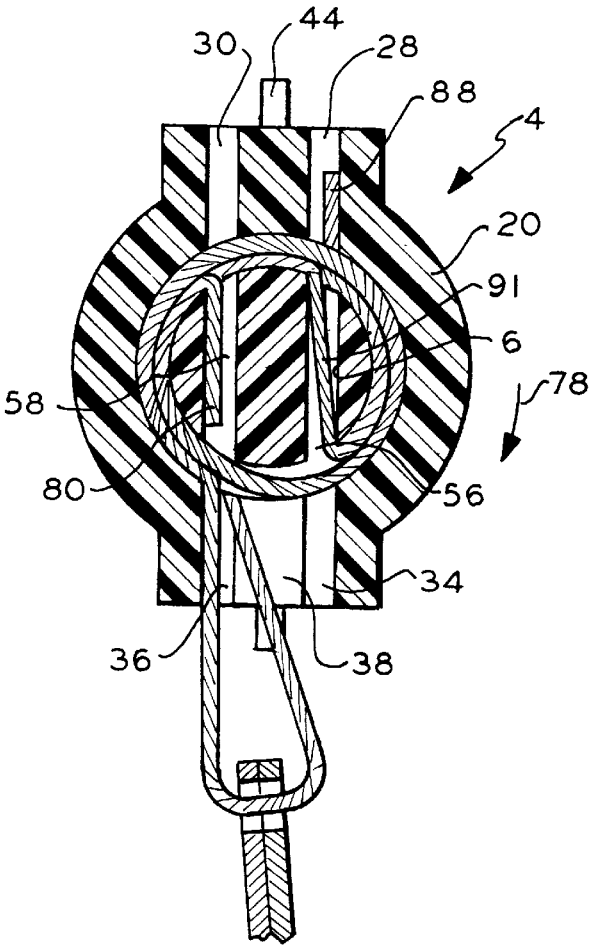
FIG. 16 is a top plan sectional view of the seal of FIG. 2 showing the final locking state of the filament and the rotor and housing assemble.

In FIG. 16, the rotor 6 is then further rotated in direction 78 multiple full turns, e.g., three, to fully wrap the filament about the rotor in the channel 54 as shown. The channel 54 is sufficiently large to receive such multiple turns. While three turns has been described as preferable, more or fewer may be provided in accordance with a particular implementation. The ratchet and pawl mechanism of teeth 26 and 68 of the housing 4 and rotor 6, respectively, locks the rotor to the position it is rotated to and prevents it from reversing direction at each stage of the rotor rotation. The teeth 24, FIG. 8, are provided in sufficient pitch and spacing to permit gradual incremental rotation of the rotor to its final locked position of FIG. 16. The shoulder 64 of ridge 60 FIG. 3 axially locks the rotor in place during its rotation.

The bottom of the housing 4 may contain indentations 96 FIGS. 3 and 5, to further assist in holding the housing 4 against rotation if deformation of the filament 8 requires high torque.

Rotation of the rotor 6 deforms the filament 8 in a direction normal to the axis of rotation of the rotor 6 by wrapping the filament in relatively sharp 180° bends at the junction between the rotor bores and the rotor external surface in the channel 54. These sharp bends lock the filament 8 to the rotor and prevent both removal of the filament 8 from and. opening of the seal 2. When the rotor is fully inserted in the housing, FIGS. 3 and 5, the upper surface of head 49 of the rotor 6 is preferably coplanar with the housing 4 upper surface 98 and forms a smooth surface with the upper surface 98. Such smooth surface makes it difficult for tampering action to separate the rotor 6 from the housing 4 after axially locking the rotor in the housing 4 chamber 18. No tool is needed or used to rotate the rotor.

Other features of the seal 2 may also contribute to obviating disassembly of the seal 2. First, as noted, wrapping and deforming the filament tends to resist axial removal of the rotor 6 from the housing 4. Second, the interlocked ridge-groove pair 60, 41 resists axial opening of the seal 2. Third, the teeth 24, 68 help to defeat opening of the seal 2. Fourth, the cowls 46 and 48, if present, inhibit the insertion of a slender elongated object into one of the bores 28, 30, 34 and 36 and slot 38. The effective lengthening of the bores 28, 30, 34, 36 and slot 38 by the cowls 46 and 48 minimizes a tampering object engaging the rotor 6 in a position where levering forces can be applied.

If the rotor 6 and housing 4 are, as preferred, molded, from frangible thermoplastic, attempts to tamper with the seal 2 will be evident by the chipping, cracking or crazing thereof following the application of tampering forces.

The housing 4 and rotor 6 of the rotatable seal 2 may be made from strong and essentially semi-rigid materials such as metal, rubber, plastics, etc. A preferred material is acrylic plastic but may be what are referred to as engineered plastics having relatively high melt and strength parameters. The housing 4 and rotor 6 of the rotatable seal 2 may also be made from clear materials. This permits visual alignment of the bores 28, 30, 34, 36, 56 and 58 and, also, the positive locking of the seal filament 8 can be inspected and provide a visual indication of tampering.

When the filament 8 is a monofilament of size-on-size it may have an outer diameter that is closely matched to the diameter of the various bores. This permits closer tolerances of the bores to the filament to further resist tampering.

When the seal 2 is in the locked condition, the inter-fitting rotor 6 and housing 4 must be destroyed, or the seal filament 8 cut to remove the seal 2 from the hasp 92 so that the hasp members can be moved or operated. Due to the strong materials of construction, substantial effort is required. either to destroy the housing 4 and rotor 6 or to cut the filament 8. However, if such destruction or cutting is effected, there is provided an easily detectable indication of tampering.

Figure 17:
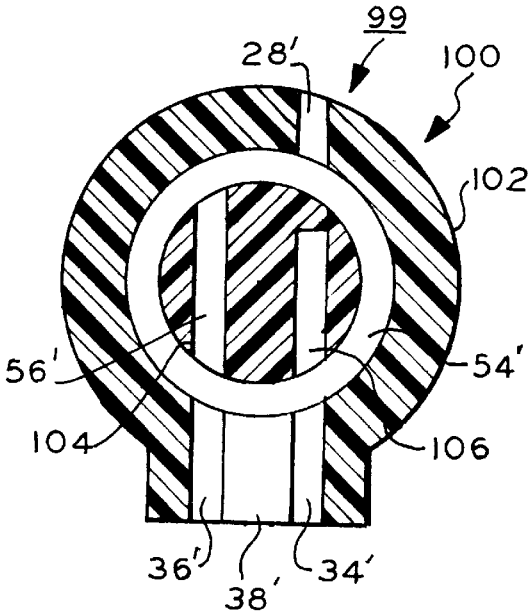
FIG. 17 is a top plan sectional view of a second embodiment of a seal of the present invention.

In an alternative embodiment, in FIG. 17, seal 99 housing 100 has a wall 102 and is otherwise identical to housing 4 except bore 30 is omitted. The primed reference numerals in FIG. 17 represent identical structure in the housing 4 with the same unprimed reference numerals. Rotor 104 has the same exterior shape and configuration and is otherwise identical to the rotor 6 except it has one through bore 56' and one blind bore 106. Bores 56' and 36' are aligned in the initial stage and bores 28', 106 34' are aligned initially. Slot 38' is between bores 36' and 34' and serves the same function as in the comparable slot 38 of seal 2.

In operation, the filament end 80, FIG. 12, is inserted into the blind bore 106. Thereafter, the filament 8 is secured to the seal 99 in the same manner as described above in connection with FIGS. 12–16 by rotating the rotor 104 180° to the position of FIG. 13. As before, the loop size is determined by the length of the filament passed through the aligned bores 28', 56' and 34' and also when the rotor is rotated.

When the filament (not shown in FIG. 17) is in the position of FIG. 13, the remainder of the filament is locked in similar fashion to the seal 99 to that as shown in FIGS. 14–16, for seal 2. Because the bores are all in one plane, the slot 38 permits the secured staked filament of FIG. 13 to traverse in alignment with the rotated bore 58 of the rotor. This frees up the bores 28, 56 and 34 on the other side of the rotor and housing for receiving the other filament end 88 and portion 91 as shown in FIG. 14. The two inserted filament portions 84, 94, FIG. 15, at the egress to the seal thus are substantially coplanar and in communication with each other via slot 38.

Without the slot 38, the filament 8, if inserted in bore 34 as in FIG. 12, after rotation of the rotor, would remain on the right hand side of the housing instead of shifting left as in FIG. 13. In this case, none of the bores would be free to receive the filament portion 91 as in FIGS. 13 and 14. The slot 38 therefore is important to the operation of the seal 2.

Still other arrangements of bores may be made according to a given implementation. For example, the bore 28'. FIG. 17, may also be omitted if desired and if the loop 89, FIG. 14, of the filament need not be adjusted prior to locking the seal to the filament. Also, one large bore may be provided in the rotor instead of two bores. Such a large bore however weakens the rotor and is not as desirable. While separate bores and slot 38 are shown, these in another arrangement may be a one thickness slot throughout in the transverse direction instead of a narrowed slot width in the axial direction coupled by larger diameter bores as shown.

Figure 18:
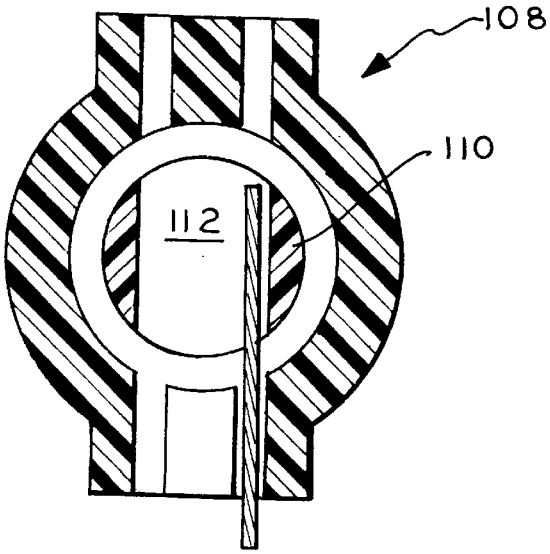
FIG. 18 is a top plan sectional view of a third embodiment of a seal of the present invention.

In a further embodiment in FIG. 18, seal 108 may have a rotor 110 having a transversely extending slot 112 in place of the two bores 56 and 58 of the rotor 6 of FIGS. 4 and 5. The slot 112 may be of uniform thickness into the drawing sheet or may have different thicknesses similar to the slot 38 and bores 34, 36 in communication with the slot 38 as shown in FIGS. 7–10.

While the present invention has been described with regard to certain embodiments, it should be understood that variations and modifications will be obvious to those skilled in the art without departing from the scope of the present invention as defined in the appended claims.

What is claimed is:

1. A security seal comprising:

a filament;

a housing defining a chamber having an axis, an opening through the housing in communication with the chamber and lying in a plane, first and second portions of said filament received in the opening in side-by-side communicating relation in said plane in said opening;

a rotor in the chamber having at least one bore and rotatable about the axis, the at least one bore in the rotor being aligned with the opening in said plane, third and fourth portions of said filament received in the at least one bore; and one way motion means for permitting the rotor to be relatively rotated with respect to the housing in only one direction about the axis for wrapping said received filament about said rotor to secure the received filament to the rotor and housing.

2. The seal of claim 1 wherein the opening comprises a slot extending transverse the axis.

3. The seal of claim 2 wherein the slot comprises first and second bores in spaced relation and a slot portion intersecting each said first and second bores, said at least one bore comprising adjacent spaced third and fourth bores lying in said plane, the third bore being aligned with the first bore and the fourth bore being aligned with the second bore.

4. The seal of claim 3 wherein the housing has fifth and sixth bores, the first and third bores being aligned with the fifth bore and the second and fourth bores being aligned with the sixth bore in said plane.

5. The seal of claim 4 wherein said filament has opposite first and second ends, said filament comprising a flexible elongated member, the first end terminating in the fourth bore and wrapped about the rotor one half a revolution in the chamber and connected to the first filament portion, the third filament portion extending from the second portion through the third and fifth bores to the second end external the housing, and a filament loop external the housing extending from the first and second filament portions.

6. The seal of claim 1 wherein the housing has a pair of lips in the chamber on opposing housing walls, each lip having coplanar first surfaces normal to the axis, the rotor having a shoulder having a second surface normal to the axis and complementary to and for engaging each said lips for axially locking the rotor to the housing.

7. The seal of claim 6 wherein said lip is linear and has a surface that extends through opposing through-bores in the housing.

8. The seal of claim 1 wherein the rotor and housing define an annular channel therebetween in said plane, said channel for receiving multiple wrappings of said filament about said rotor.

9. The seal of claim 8 wherein the channel has a cross sectional area of at least quadruple the cross sectional area of said filament.

10. The seal of claim 1 wherein said one way motion means comprises complementary ratchet and pawl means secured to the rotor and to the housing in the chamber.

11. The seal of claim 1 wherein the housing and the rotor have complementary surface features for axially retaining the rotor to the housing.

12. The seal of claim 1 including means radially extending from the housing to provide a finger grip, and a finger gripping flange extending from the rotor for manually rotating the rotor in said chamber.

13. A seal comprising:

a filament;

a housing defining a chamber having an axis, a slot through the housing in communication with the chamber and lying in a plane, first and second portions of said filament in side-by-side communicating relation in said slot, at least one through-opening in the housing on a side opposite to and aligned with said slot in said plane;

a rotor in the chamber having at least one bore and rotatable about the axis, the at least one bore being aligned with the slot in the plane and with the through-opening in the housing in said plane, third and fourth portions of the filament received in the at least one bore, a portion of the filament being received in the through-opening;

one way motion means for permitting the rotor to be relatively rotated with respect to the housing in only one direction about the axis for wrapping the received filament about said rotor to secure the filament to the rotor and housing; and means for axially locking the rotor to the housing in the chamber while permitting the rotor to rotate in the chamber.

14. The seal of claim 13 wherein the means for axially locking comprises a lip in the chamber on opposing housing sides and a complementary shoulder on the rotor for engaging the lip with mutually parallel surfaces lying in a plane normal to the axis.

15. The seal of claim 13 wherein the filament has a diameter of a given magnitude, the rotor and housing forming an annular interior channel about the rotor having an axial height and a radially extending width transverse the axis, each said height and width being at least about twice the given magnitude, said channel for receiving multiple turns of said filament about the rotor.

16. The seal of claim 13 wherein the at least one bore comprises a pair of side-by-side spaced bores.

17. The seal of claim 13 wherein the at least one bore comprises a slot.

18. A security seal comprising:

a housing defining a chamber having an axis, an opening through the housing in communication with the chamber and lying in a plane;

a rotor in the chamber having at least one bore and rotatable about the axis, the at least one bore in the rotor being aligned with the opening in said plane;

a filament received in said opening and at least one bore, said filament having first and second portions in said opening lying in communicating side-by-side relation, the filament having third and fourth portions received in said at least one bore; and one way motion means for permitting the rotor to be relatively rotated with respect to the housing in only one direction about the axis for wrapping said received filament about said rotor to secure the filament to the rotor and housing.

19. A seal for use with a flexible filament for non-removable attachment of the filament to an article, the seal comprising:

a housing defining a chamber having an axis, an opening comprising a slot extending transverse the axis through the housing in communication with the chamber and lying in a plane, said opening for receiving therethrough first and second portions of said filament in side-by-side communicating relation in said plane;

a rotor in the chamber having at least one bore and rotatable about the axis, the at least one bore in the rotor being aligned with the opening in said plane for receiving said filament; and one way motion means for permitting the rotor to be relatively rotated with respect to the housing in only one direction about the axis for wrapping said filament received in said at least one bore and in the opening about said rotor to secure the filament to the rotor and housing;

the slot comprising first and second bores in spaced relation and a slot portion intersecting each said first and second bores, said at least one bore comprising adjacent spaced third and fourth bores lying in said plane, the third bore being aligned with the first bore and the fourth bore being aligned with the second bore.

20. A security seal for use with a flexible filament for non-removable attachment of the filament to an article, the seal comprising:

a filament;

a housing defining a chamber having an axis, an opening comprising a slot extending through the housing in communication with the chamber and lying in a plane, first and second portions of said filament received in the opening in side-by-side communicating relation in said plane in said opening;

a rotor in the chamber having at least one bore and rotatable about the axis, the at least one bore in the rotor being aligned with the opening in said plane, third and fourth portions of said filament received in said at least one bore in said plane; and one way motion means for permitting the rotor to be relatively rotated with respect to the housing in only one direction about the axis for wrapping said received filament about said rotor to secure the received filament to the rotor and housing;

the slot comprising first and second bores in spaced relation and a slot portion intersecting each said first and second bores, said at least one bore comprising adjacent spaced third and fourth bores lying in said plane, the third bore being aligned with the first bore and the fourth bore being aligned with the second bore;

the housing having fifth and sixth bores, the first and third bores being aligned with the fifth bore and the second and fourth bores being aligned with the sixth bore in said plane;

said filament having opposite first and second ends, said filament comprising a flexible elongated member, the first end terminating in one of the third and fourth bores and wrapped about the rotor one half a revolution in the chamber, said filament passing through said opening with its second end external the housing.

21. A seal for use with a flexible filament for non-removable attachment of the filament to an article, the seal comprising:

a housing defining a chamber having an axis, an opening comprising a slot extending through the housing in communication with the chamber and lying in a plane, the slot having first and second bores in spaced relation and a slot portion intersecting each said first and second bores, said opening for receiving therethrough first and second portions of said filament in side-by-side communicating relation in said plane;

a rotor in the chamber having at least one bore and rotatable about the axis, the at least one bore in the rotor being aligned with the opening in said plane for receiving said filament; and one way motion means for permitting the rotor to be relatively rotated with respect to the housing in only one direction about the axis for wrapping said filament received in said at least one bore and in the opening about said rotor to secure the filament to the rotor and housing.

* * * * *

UNITED STATES PATENT AND TRADEMARK OFFICE

CERTIFICATE OF CORRECTION

PATENT NO. : 6,000,736

DATED : December 14, 1999

INVENTOR(S) : Leon, et. al.

It is certified that error appears in the above-identified patent and that said Letters Patent is hereby corrected as shown below:

Title page, item [56], under

References Cited

U. S. PATENT DOCUMENTS add the followings:

| | | | |
|---|---|---|---|
| 5,788,294 | 8/4/98 | Leon, et al. | 292/307R |
| 5,782,513 | 7/21/98 | Nazzari | 292/317 |
| 5,647,620 | 7/15/ 97 | Kuenzel | 292/307R |
| 2,003,755 | 6/4/35 | Moore | 292/307R |
| 1,911,060 | 5/23/33 | Clark | 292/307R |
| 1,826,033 | 10/6/31 | Webster | 292/307R |
| 421,951 | 1890 | MacCarthy | 292/307R |

Signed and Sealed this

Sixth Day of February, 2001

*Attest:*

*Attesting Officer*

Q. TODD DICKINSON

*Director of Patents and Trademarks*